US006617800B2

(12) United States Patent
Onozawa et al.

(10) Patent No.: US 6,617,800 B2
(45) Date of Patent: Sep. 9, 2003

(54) PLASMA DISPLAY APPARATUS

(75) Inventors: Makoto Onozawa, Kawasaki (JP); Tomokatsu Kishi, Kawasaki (JP); Shigetoshi Tomio, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/059,287

(22) Filed: Jan. 31, 2002

(65) Prior Publication Data

US 2003/0001513 A1 Jan. 2, 2003

(30) Foreign Application Priority Data

Jun. 27, 2001 (JP) ..... 2001-195036

(51) Int. Cl.[7] ..... G09G 3/10

(52) U.S. Cl. ..... 315/169.3; 315/169.4; 345/60; 345/78

(58) Field of Search ..... 315/169.3, 169.4, 315/169.2, 169.1; 345/60, 55, 30, 78

(56) References Cited

U.S. PATENT DOCUMENTS 5,446,344 A * 8/1995 Kanazawa ..... 315/169.4
5,654,728 A * 8/1997 Kanazawa et al. ..... 345/68
5,828,353 A 10/1998 Kishi et al. ..... 345/60
5,844,373 A 12/1998 Yao et al. ..... 315/169.4
6,011,355 A * 1/2000 Nagai ..... 315/169.3
6,249,087 B1 * 6/2001 Takayama et al. ..... 315/169.1
6,483,250 B1 * 11/2002 Hashimoto et al. ..... 345/60

FOREIGN PATENT DOCUMENTS

| | | |
|---|---|---|
| EP | 1 065 650 A2 | 1/2001 |
| JP | 53-047727 | 4/1978 |
| JP | 6-332401 | 12/1994 |
| JP | 9-325735 | 12/1997 |
| JP | P3201603 | 6/2001 |

* cited by examiner

*Primary Examiner*—Don Wong
*Assistant Examiner*—Ephrem Alemu
(74) *Attorney, Agent, or Firm*—Staas & Halsey LLP

(57) ABSTRACT

A plasma display apparatus with small-sized circuits and of a low cost has been disclosed. The apparatus comprises a display panel, having first electrodes and second electrodes adjacently arranged by turns and third electrodes that extend in the direction intersecting the first electrodes and the second electrodes, opposed to each other so as to sandwich a discharge area therebetween, an X drive circuit that drives the first electrodes, a Y drive circuit that drives the second electrodes, an address drive circuit that drives the third electrodes, and a secondary power supply that uses a pulse relating to the drive signal generated in the X drive circuit or the Y drive circuit.

26 Claims, 16 Drawing Sheets

PLASMA DISPLAY APPARATUS

BACKGROUND OF THE INVENTION

The present invention relates to a plasma display (PDP) apparatus. More particularly, the present invention relates to a power supply circuit that generates voltages other than those supplied from the outside of the PDP apparatus.

The PDP apparatus has been put to practical use as a plane display, and it is expected that it will be used as a thin high-intensity display. FIG. 1 is a diagram that shows the general structure of a conventional three-electrode AC-driven PDP apparatus. As shown schematically, the PDP apparatus comprises a plasma display panel (PDP) 1 composed of two substrates, between which a discharge gas is enclosed, having plural X electrodes and Y electrodes adjacently arranged by turns with plural address electrodes arranged in the direction intersecting thereto and fluorescent substances arranged at the intersecting points, an address drive circuit 2 that applies such as an address pulse to the address electrode, an X common drive circuit 3 that applies such as a sustain discharge (sustain) pulse to the X electrode, a Vx voltage supply circuit 4 that supplies a voltage Vx, which will be described later, to the X common drive circuit 3, a scan circuit 5 that sequentially applies such as a scan pulse to the Y electrode, a Y drive circuit 6 that supplies such as a sustain discharge (sustain) pulse, which is to be applied to the Y electrode, to the scan circuit 5, a reset circuit 7 that supplies a reset voltage Vw, which will be described later, to the Y drive circuit 6, a control circuit 8 that controls each section, and a power supply circuit 9 that supplies various voltages such as Vs, Vw, Vx, and Va to each section. Since the PDP apparatus is widely known, a more detailed description of the whole apparatus is omitted here, but the power supply circuit that relates to the present invention is further described.

FIG. 2 illustrates the drive waveforms that show the signals to be applied to each electrode in the PDP apparatus. In the PDP apparatus, a display cell is formed at the intersecting point of a pair of an X electrode and a Y electrode and of an address electrode. The displaying operation is composed of a reset period in which each cell is put into a uniform state, an address period in which a cell to be displayed is selected, and a sustain (sustain discharge) period in which the selected cell is caused to discharge, and a continuous display is attained by the repetition of this series of operations.

As shown schematically, in the reset period, a pulse, the maximum voltage of which is Vw, is applied to the Y electrode while the X electrode and the address electrode are being kept to 0 V (ground level) and a discharge is caused to occur in every cell to attain a uniform state. In the address period, in the state in which the voltage Vx is being applied to the X electrode, a scan pulse, the voltage of which changes from the voltage Vs to the ground level, is sequentially applied to the Y electrode. By applying an address pulse of voltage Va to the address electrode of the cell that is made to emit light in synchronization with the scan pulse, a discharge is caused to occur in the cell that is made to emit light and wall charges are formed. In this way, a state in which all the cells correspond to the display data, that is, a state in which wall charges are formed in the cell that is made to emit light and wall charges are not formed in the cell that is not made to emit light, is attained. In the sustain period, in the state in which 0 V is being applied to the address electrode, a sustain pulse of voltage Vs is applied alternately to the X electrode and the Y electrode. (When the sustain pulse is not applied, 0 V is applied.) In the cell in which wall charges are formed, a discharge is caused to occur because the voltage due to the wall charges is added to the Vs, but no discharge is caused to occur in the cell in which wall charges are not formed.

FIG. 2 shows only an example, and various modifications of the drive waveforms are proposed. Moreover, the voltages Vs, Vw, Vx, and Va in FIG. 2 are specified adequately according to the structure and the intensity of the light emission of the plasma display panel and, for example, Vs is 150-180 v, Vw is greater than Vs, and Vx is also greater than Vs in the example shown in FIG. 2. In any case, it is necessary to apply plural high voltages to each electrode in the PDP apparatus, and the power supply circuit 9 supplies each high voltage. Although not shown schematically, the power supply voltage of the control circuit is 5 V (or 3 V) but this voltage is also supplied from the power supply circuit and a description is omitted below because it does not relate directly to the present invention.

The power supply circuit 9 generates the above-mentioned high voltages Vs, Vw, Vx, and Va by converting the AC input voltage from AC to DC, or first generates the voltage Vs, which needs a large current capacity, by the conversion from AC to DC, then generates Vw and Vx by converting the generated Vs from DC to DC. Generally, the latter method is employed. The voltage Va (Vx is also included when Vx<Vs), which is less than Vs, can be generated from Vs with the aid of a step-down circuit. In this way, the operation is enabled only by the supply of the AC input voltage generally used as a voltage supplied from the outside. The small sized power supply device appropriate for the use in the PDP has been disclosed in Japanese Unexamined Patent Publication (Kokai) No. 6-332401. Moreover, in Japanese Unexamined Patent Publication (Kokai) No. 9-325735, a structure has been disclosed, which can reduce the power consumption due to the application of the sustain pulse between the X electrode and the Y electrode in the sustain period.

As described above, the power supply circuit in the PDP apparatus generates Vw and Vx by converting Vs from DC to DC, which has been generated by the conversion from AC to DC, therefore, a DC-to-DC conversion circuit composed of such as an oscillator circuit and a switching device is provided, this causing the circuits to be large in the PDP apparatus.

SUMMARY OF THE INVENTION

The object of the present invention is to reduce both the circuit size and the cost by simplifying the structure of the circuit to generate Vw and Vx.

In order to realize the above-mentioned object, the plasma display (PDP) apparatus according to a first aspect of the present invention comprises a secondary power supply that utilizes a pulse relating to the drive signal generated in an X drive circuit that drives a first electrode or in a Y drive circuit that drives a second electrode. By this characteristic, an oscillator circuit, a switching device, and so on, which are conventionally necessary to form the secondary power sources such as the power supply voltages Vw and Vx, can be eliminated, resulting in reductions in circuit size and in cost.

The pulse appropriate to be used by the secondary power supply is a pulse relating to the sustain pulse generated in the sustain period.

The secondary power supply is structured so as to comprise, for example, a charge-pump circuit that is driven by the above-mentioned pulse and a rectifier circuit that generates a direct current voltage by rectifying the output of the charge-pump circuit. In this case, if a charge-pump circuit equipped with plural stages that enter the output of the preceding stage as the base voltage of the subsequent stage is provided, it is possible to generate a voltage two or more times the voltage of the pulse to be used.

In another example of structure of the secondary power supply, a transformer, the primary of which is provided with a pulse, and a rectifier circuit that generates a direct current voltage by rectifying the output of the secondary of the transformer, are provided.

Moreover, if a voltage stabilizer circuit that converts the output of the rectifier circuit of the secondary power supply into a fixed voltage is further provided, an arbitrary voltage can be stably obtained.

The voltage generated by the secondary power supply generates either the voltage Vx to be applied to the first electrode in the address period or the voltage Vw to be applied to the second electrode in the reset period, or both.

As described above, conventionally the power supply voltages Vw and Vx are generally generated from the power supply voltage Vs to be used to generate the sustain pulse. However, the power supply voltage Va to be supplied to the address drive circuit is also generated, and it is possible to use Va as well as Vs to generate the power supply voltages Vw and Vx, and in this case, it is necessary to ensure the reliability of the circuit. The PDP apparatus in the second embodiment of the present invention will realize such a structure.

In other words, the plasma display (PDP) apparatus according to a second aspect of the present invention is characterized in that: a second power supply voltage (Va) is supplied to the address drive circuit; the second power supply voltage as well as a first power supply voltage (Vs) is supplied to both the X drive circuit and the Y drive circuit; and a circuit is provided, which passes a current from the path through which the second power supply voltage is supplied to the address drive circuit to the path through which the first power supply voltage is supplied to the X drive circuit and the Y drive circuit when the first power supply voltage is less than the second power supply voltage.

The circuit, which passes a current from the path through which the second power supply voltage is supplied to the address drive circuit to the path through which the first power supply voltage is supplied to the X drive circuit and the Y drive circuit, is a protection switch.

Normally, Vs>Va, but it may happen that Vs<Va because Va rises prior to Vs due to the sequence of power on in the transition period such as power on and power off. In this case, it can happen that an abnormal current flows to the X drive circuit and the Y drive circuit via circuits that form the secondary power supply, but such an abnormal current can be prevented and a circuit malfunction, and so on, can be avoided according to the second aspect of the present invention.

BRIEF DESCRIPTION OF THE DRAWINGS

The features and advantages of the invention will be more clearly understood from the following description taken in conjunction with the accompanying drawings, in which.

DETAILED DESCRIPTION OF THE PREFERRED EMBODIMENTS

Figure 1:
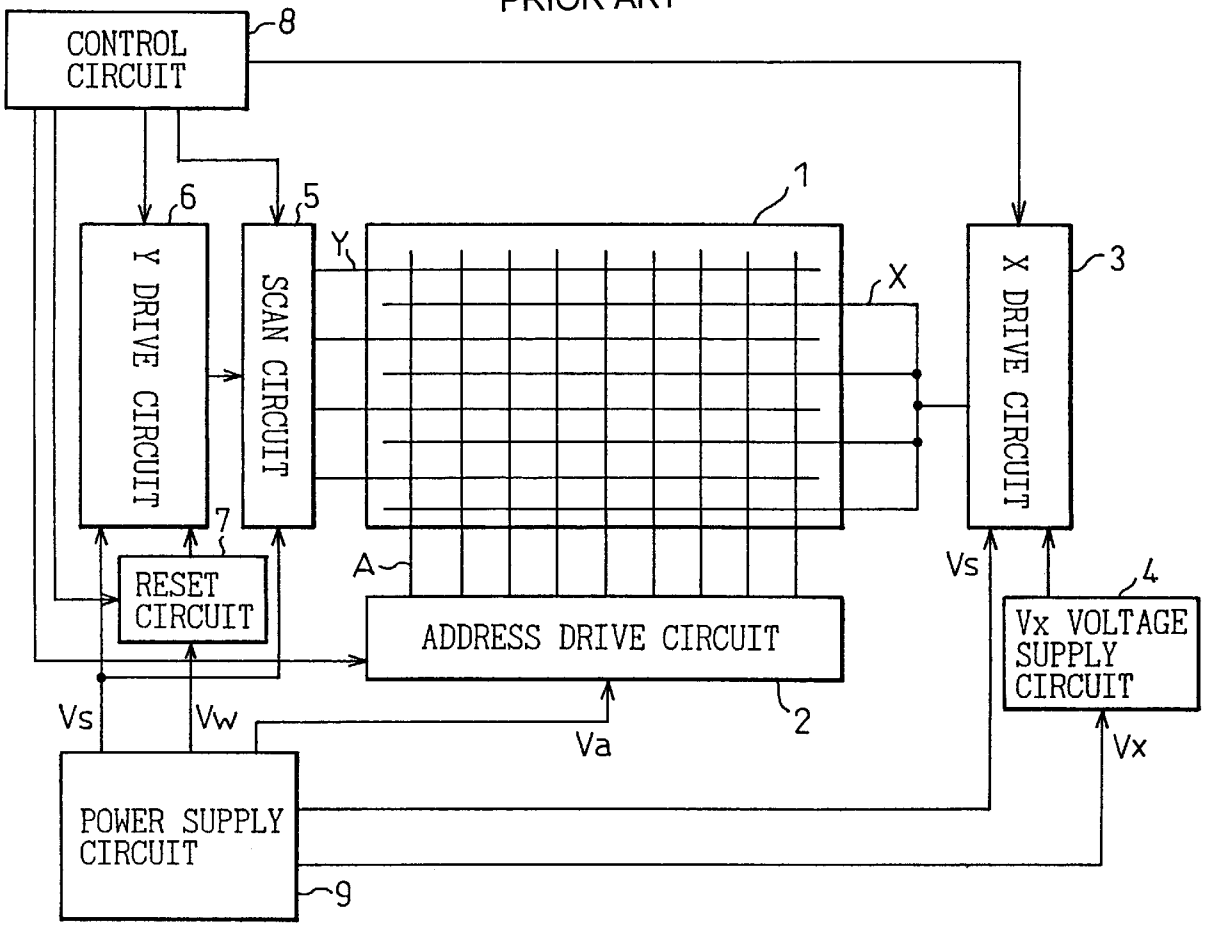
Fig.1 PRIOR ART
FIG. 1 is a block diagram of a conventional plasma display (PDP) apparatus.
Figure 2:
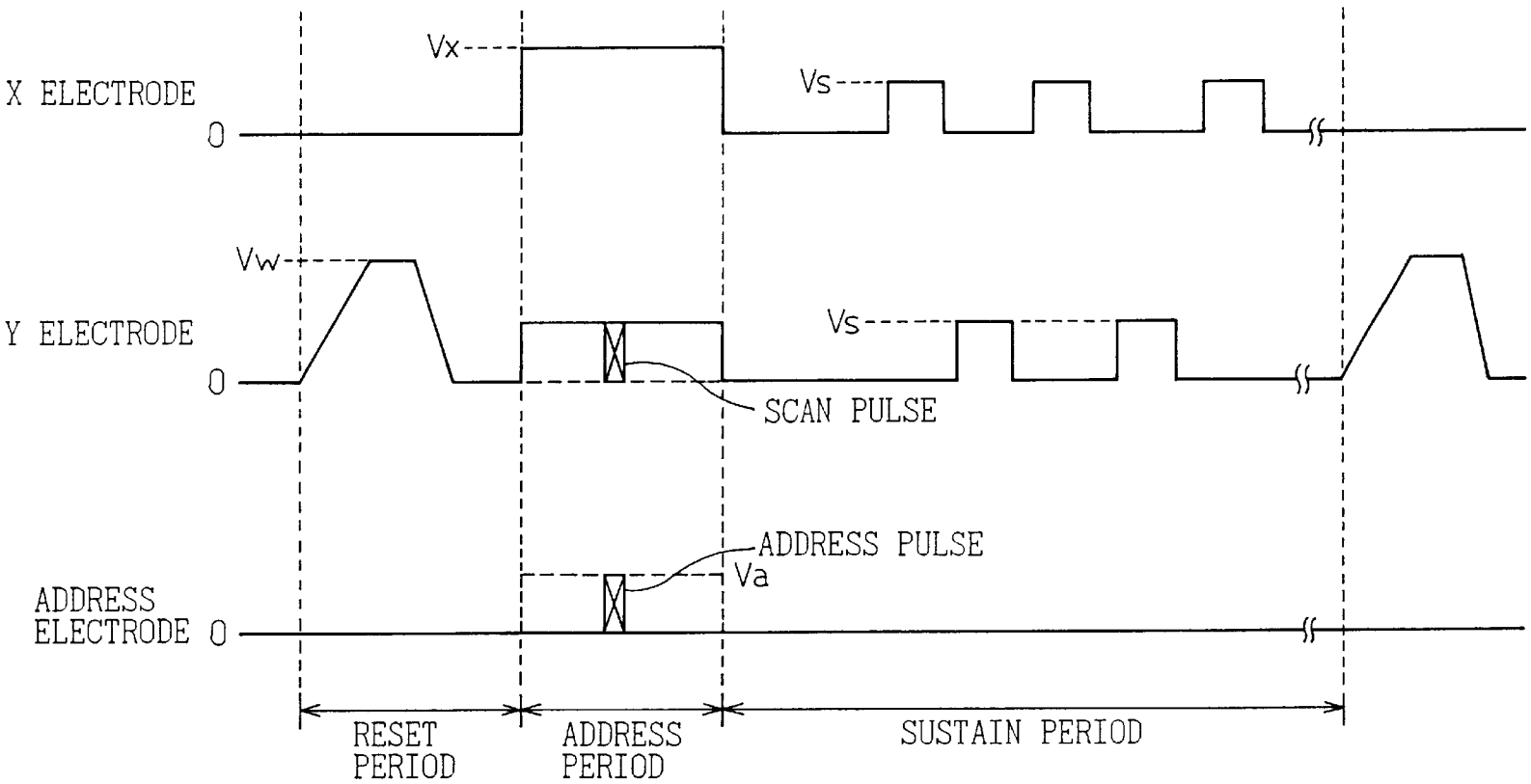
FIG. 2 is a diagram that shows the drive waveforms of the PDP apparatus.
Figure 3:
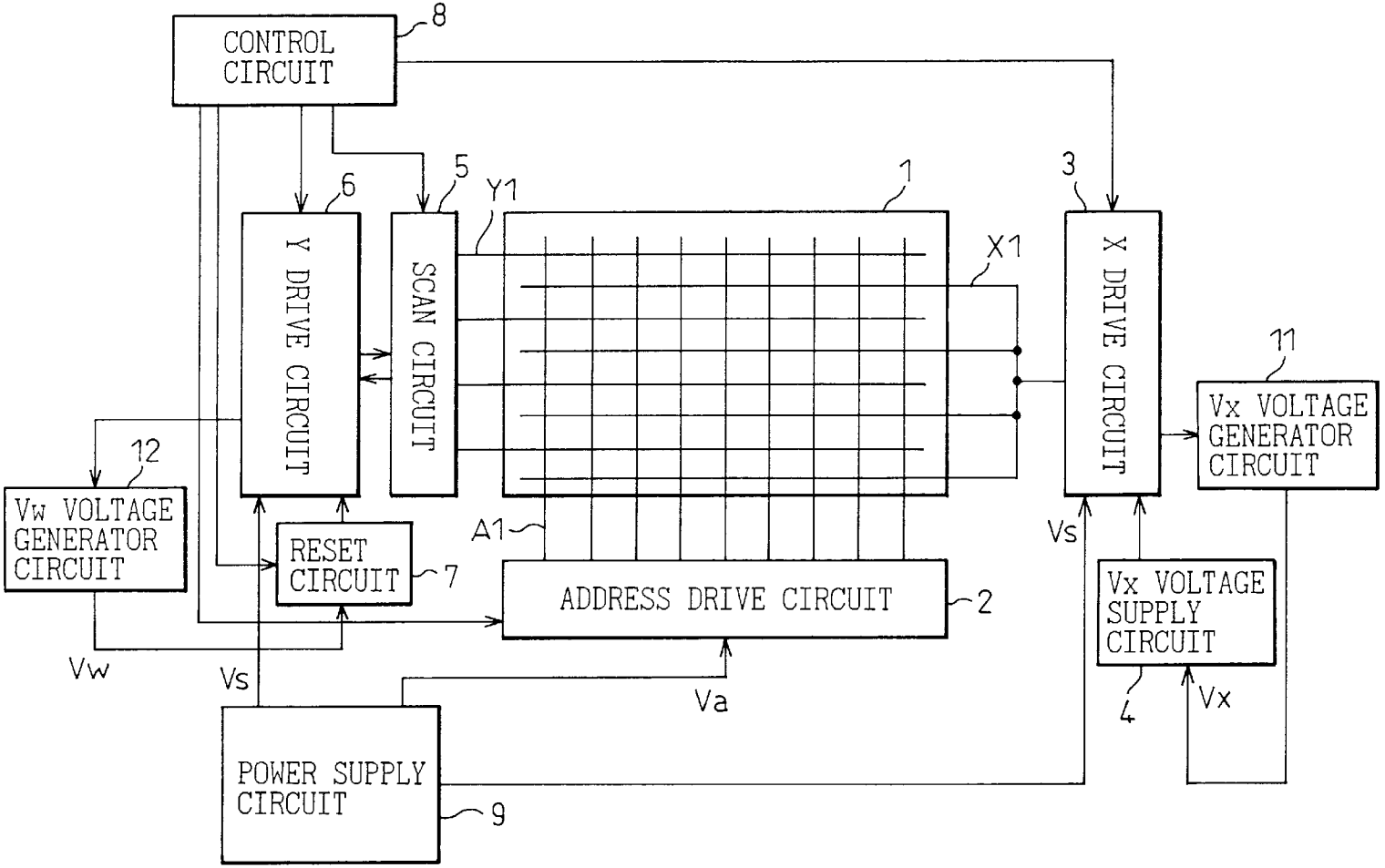
FIG. 3 is a block diagram of the PDP apparatus in the first embodiment of the present invention.

FIG. 3 is a block diagram that shows the rough structure of the PDP apparatus in the first embodiment of the present invention. It is obvious, from the comparison with FIG. 1, that the conventional PDP apparatus in FIG. 1, differs from that in the first embodiment in that, while the power supply voltages Vx and Vw are generated in the power supply circuit 9 in the conventional PDP apparatus, in the PDP apparatus in the first embodiment, a Vx voltage generator circuit 11 and a Vw voltage generator circuit 12 are provided, which generate the power supply voltages Vx and Vw, respectively, by utilizing the pulse signal relating to the sustain pulses generated in the X drive circuit 3 and the Y drive circuit 6, respectively, and the voltages Vx and Vw generated thereby are supplied to the voltage supply circuit 4 and the voltage supply circuit 7, and other parts are identical with those of FIG. 1. Therefore, the power supply circuit 9 generates only the power supply voltages Vs and Va in the PDP apparatus in the first embodiment. Although the power supply voltages Vs, Va, Vw, and Vx are specified adequately in accordance with the condition of the panel, the following description of embodiments assumes that Va<Vs<Vx<Vw. It is also assumed that the drive waveforms are identical with the conventional ones shown in FIG. 2 in the following description.

Figure 4:
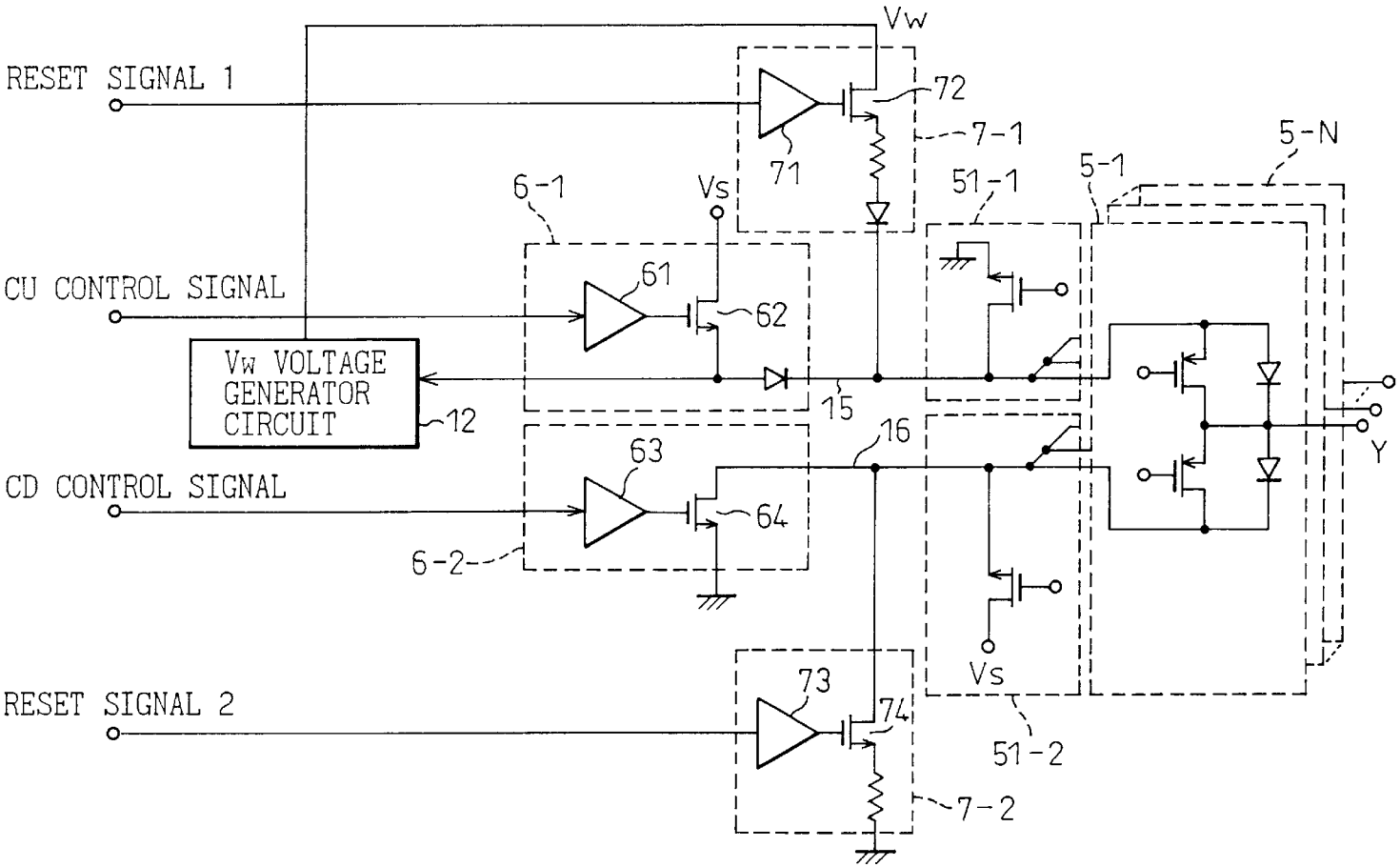
FIG. 4 is a diagram that shows the circuit structure of the drive section on the Y side in the first embodiment.

FIG. 4 is a diagram that shows the circuit structure of the drive section on the Y electrode side. As shown schematically, each scan drive circuit 5-1, . . . , 5-N (N stands for the number of Y electrodes) is provided for each Y electrode. The scan drive circuits 5-1, . . . , 5-N are connected commonly to two drive power supply lines 15 and 16. The drive power supply line 15 is connected to a first scan power supply circuit 51-1, a first reset circuit 7-1, and a first Y drive circuit 6-1. Similarly, the drive power supply line 16 is connected to a second scan power supply circuit 51-2, a second reset circuit 72, and a second Y drive circuit 6-2. The Vw voltage generator circuit 12 is connected to the output section of the first Y drive circuit 6-1. The scan drive circuits 5-1, . . . , 5-N and the first and second scan power supply circuits 51-1 and 51-2 constitute the scan circuit 5 shown in FIG. 3, the first and second Y drive circuits 6-1 and 6-2 constitute the Y drive circuit 6 shown in FIG. 3, and the first and second reset circuits 7-1 and 7-2 constitute the reset circuit 7 shown in FIG. 3.

In each scan drive circuit, two transistors are connected in series between the drive power supply lines 15 and 16 and their connection nodes are connected to the Y electrode and, simultaneously, a diode is connected in parallel to each transistor, respectively. The first scan power supply circuit 51-1 is a circuit in which a transistor is connected between the drive power supply line 15 and the grounding line (0 V). The second scan power supply circuit 51-2 is a circuit in which a transistor is connected between the drive power supply line 16 and the power supply line of the voltage Vs. A pre-drive circuit to drive each transistor is omitted. The first Y drive circuit 6-1 comprises a transistor 62, one end of which is connected to the power supply line of the voltage Vs and the other end is connected to the drive power supply line 15, via a diode, and a pre-drive circuit 61 that drives the transistor 62 according to a CU control signal. The second Y drive circuit 62 comprises a transistor 64 connected between the grounding line (0 V) and the drive power supply line 15 and a pre-drive circuit 63 that drives the transistor 64 according to a CD control signal. The first reset circuit 7-1 comprises a transistor 72 connected between the drive power supply line 15 and the output line of the Vw voltage generator circuit 12 and a pre-drive circuit 71 that drives the transistor 72 according to a reset signal 1. The reset circuit 7-2 comprises a transistor 74 connected between the drive power supply line 16 and the grounding line (0 V) and a pre-drive circuit 73 that drives the transistor 74 according to a reset signal 2. The operation will be described later.

Figure 5:
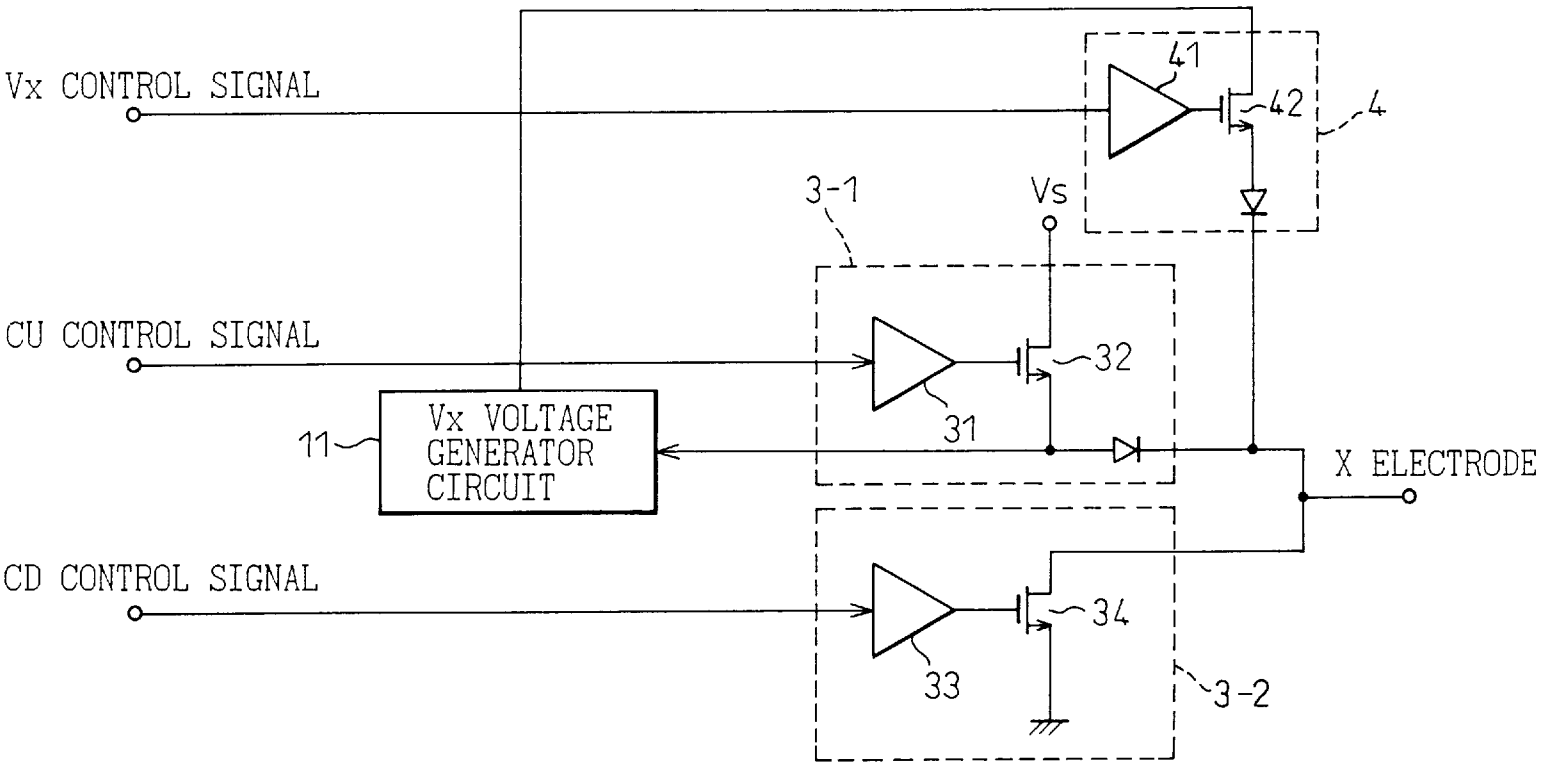
FIG. 5 is a diagram that shows the circuit structure of the drive section on the X side in the first embodiment.

FIG. 5 is a diagram that shows the circuit structure of the drive section on the X electrode side. As shown schematically, the X electrode is connected to the Vx voltage supply circuit 4, a first X drive circuit 3-1, and a second X drive circuit 3-2. To the first X drive circuit 3-1, the Vx voltage generator circuit 11 is connected. The first and the second X drive circuits 3-1 and 3-2 constitute the X drive circuit 3 shown in FIG. 3. The first X drive circuit 3-1 comprises a transistor 32, one end of which is connected to the power supply line of the voltage Vs and the other end, to the X electrode via a diode, and a pre-drive circuit 31 that drives the transistor 32 according to the CU control signal. The second X drive circuit 3-2 comprises a transistor 34 connected between the grounding line (0 V) and the X electrode and a pre-drive circuit 33 that drives the transistor 34 according to the CD control signal. The Vx supply circuit 4 comprises a transistor 42 connected between the X electrode and the output line of the Vx voltage generator circuit 11 and a pre-drive circuit 41 that drives the transistor 42 according to a Vx control signal.

The operations of the circuits shown in FIG. 4 and FIG. 5 are briefly described here with reference to FIG. 2. In the reset period, while all the transistors of the first and second scan power supply circuits 51-1 and 512, the first and second Y drive circuits 6-1 and 6-2, the first X drive circuit 3-1, and the Vx supply circuit 4 are being kept switched off, the transistor of the second X drive circuit 3-2 is turned on and 0 V is applied to the X electrode. At this time, the address drive circuit 2 applies 0 V to each address electrode. In this state, if the transistor 74 of the second reset circuit 7-2 is turned off and the transistor 72 of the first reset circuit 7-1 is turned on, the voltage Vw is applied to the Y electrode via the diode of each scan drive circuit and the potential of the Y electrode is raised toward the voltage Vw until Vw is reached. Then, if the transistor 72 of the first reset circuit 7-1 is turned off and the transistor 74 of the second reset circuit 7-2 is turned on, the Y electrode is lowered to 0 V via the diode. In this way, a discharge is caused to occur in all the cells regardless of the previous display status, the generated charges neutralize each other, and all the cells enter a uniform state.

In the next address period, while all the transistors of the first and second Y drive circuits 6-1 and 6-2, the first and second reset circuits 7-1 and 7-2, and the first and second X drive circuits 3-1 and 3-2 are being kept switched off, the transistor of the Vx supply circuit 4 is turned on and the voltage Vx is applied to the X electrode. Then, the transistors of the first and second scan power supply circuits 51-1 and 51-2 are turned on and Vs and 0 V are applied to the series of the transistors of the scan drive circuits 5-1, . . . , 5-N. In this state, if scan signals are sequentially applied to the series of the transistors of the scan drive circuits 5-1, . . . , 5-N, the scan signal of voltage Vs is sequentially applied to the Y electrode. In synchronization with this, the address drive circuit 2 applies Va to the address electrode of a cell to be lit and applies 0 V to the address electrode of a cell not to be lit.

In the sustain period, while all the transistors of the first and second scan power supply circuits 51-1 and 51-2, the first and second reset circuits 7-1 and 7-2, and the Vx supply circuit 4 are being kept switched off, a pair of the transistors of the first X drive circuit 31 and the second Y drive circuit 6-2 and that of the second X drive circuit 3-2 and the first Y drive circuit 6-1 are turned on and off alternately. Practically, the X electrode and the Y electrode are controlled so that both become 0 V simultaneously, but a detailed description is omitted here.

Next the Vx voltage generator circuit 11 and the Vw voltage generator circuit 12, which are the characteristics of the present embodiment, are described, but both circuits are identical as to the way they generate a higher power supply voltage by utilizing the pulse signal relating to the sustain pulse, and can be realized by almost the same circuit structure, therefore, the Vw voltage generator circuit is described as an example and the description of the Vx voltage generator circuit is omitted here.

Figure 6:
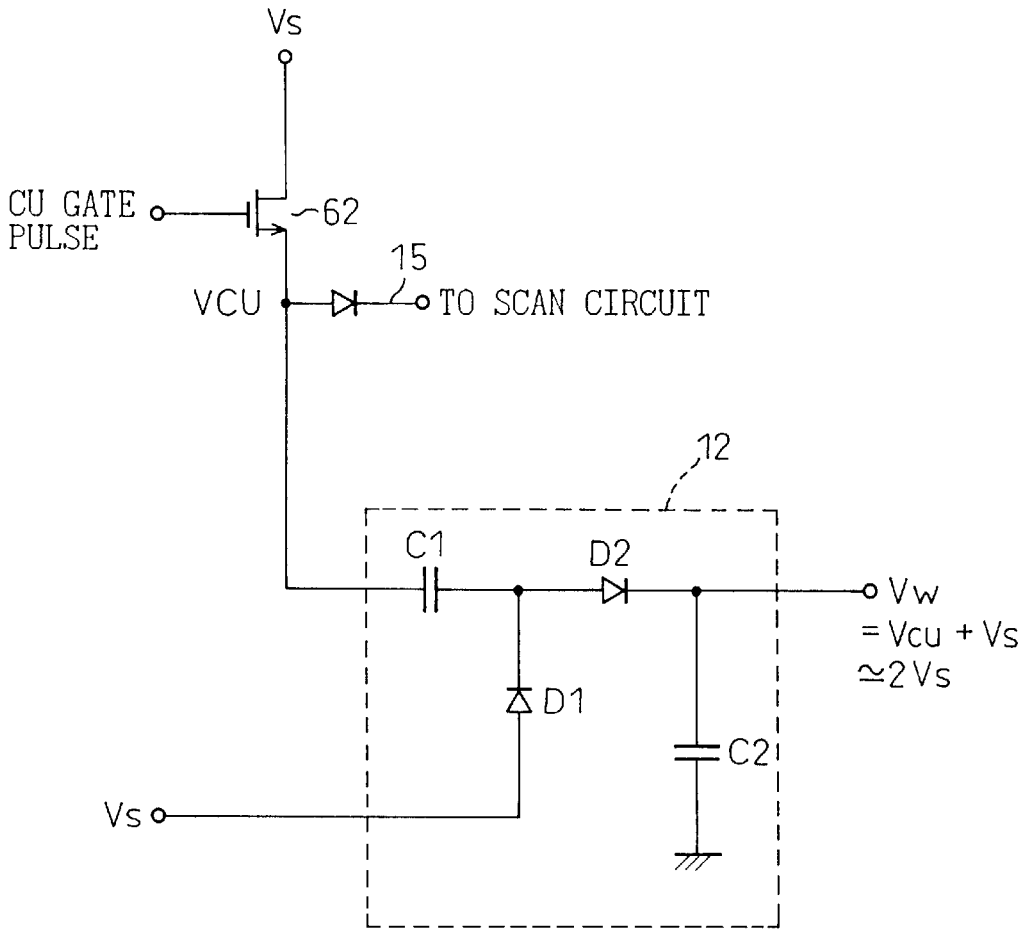
FIG. 6 is a diagram that shows the circuit structure (example 1) of the Vw voltage generator circuit in the first embodiment.

FIG. 6 is a diagram that shows an example of the first structure of the Vw voltage generator circuit. As shown schematically, in this example, the transistor 62 of the first Y drive circuit 6-1 is turned on and off according to a CU gate pulse output from the pre-drive circuit 61, and a voltage pulse VCU that varies between Vs and 0 V is output to the output terminal thereof. Therefore, the voltage pulse VCU is output only in the sustain period during which the CU control signal is output. The voltage pulse VCU is output to the scan circuit via the diode, and simultaneously supplied to the Vw voltage generator circuit 12.

As shown schematically, the Vw voltage generator circuit comprises a capacitor C1, to the first terminal of which the voltage pulse VCU is applied, a diode D1, the anode of which is connected to the power supply terminal of the voltage Vs and the cathode, to the second terminal of the capacitor C1, a diode D2 the anode of which is connected to the second terminal of the capacitor C1, and a capacitor C2 that is connected between the cathode of the diode D2 and the grounding line (GND). The capacitor C1 and the diodes D1 and D2 constitute the charge-pump circuit, and the capacitor C2 constitutes the rectifier circuit. When the voltage pulse VCU is 0 V, 0V is applied to the first terminal of the capacitor C1, Vs is applied to the second terminal, and the voltage Vs is held by the capacitor C1. In this state, if the voltage pulse VCU changes to Vs, Vs is applied to the first terminal of the capacitor C1 and, therefore, the held voltage Vs is added to the second terminal and the voltage thereof becomes 2 Vs. In this way, the anode voltage of the diode D2 varies between Vs and 2 Vs and is output from the cathode. By this, the capacitor C2 is charged and a voltage of about 2 Vs is held by the capacitor C2, if the amount of the voltage Vw to be used is small.

As described above, the CU gate pulse is output only in the sustain period, and a voltage of about 2 Vs is held by the capacitor C2 during the period, therefore, this voltage is supplied to the terminal of the transistor 72 in the first reset circuit 7-1 to be used as the power supply of Vw. As a result, the maximum voltage the Y electrode can reach when the output of the Vw generator circuit 12 is actually applied thereto via the first reset circuit 7-1 and is determined by the relationship between the capacitance of the additional circuits including the capacitance of the Y electrode and the capacitor C2 and, therefore, these are adequately set so that a desired Vw can be obtained.

As described above, the Vw generator circuit in FIG. 6 uses a signal pulse corresponding to a sustain pulse as an input pulse to the charge-pump circuit, and an oscillator circuit and a switching device, which are necessary for a normal charge-pump circuit, can be omitted and, therefore, the circuit structure can be simplified and reduced in size. Moreover, the sustain pulse to be used has a high voltage to a certain level (about 180 V) and has a large amount of electric current, therefore, it can generate a high voltage Vw.

Figure 7:
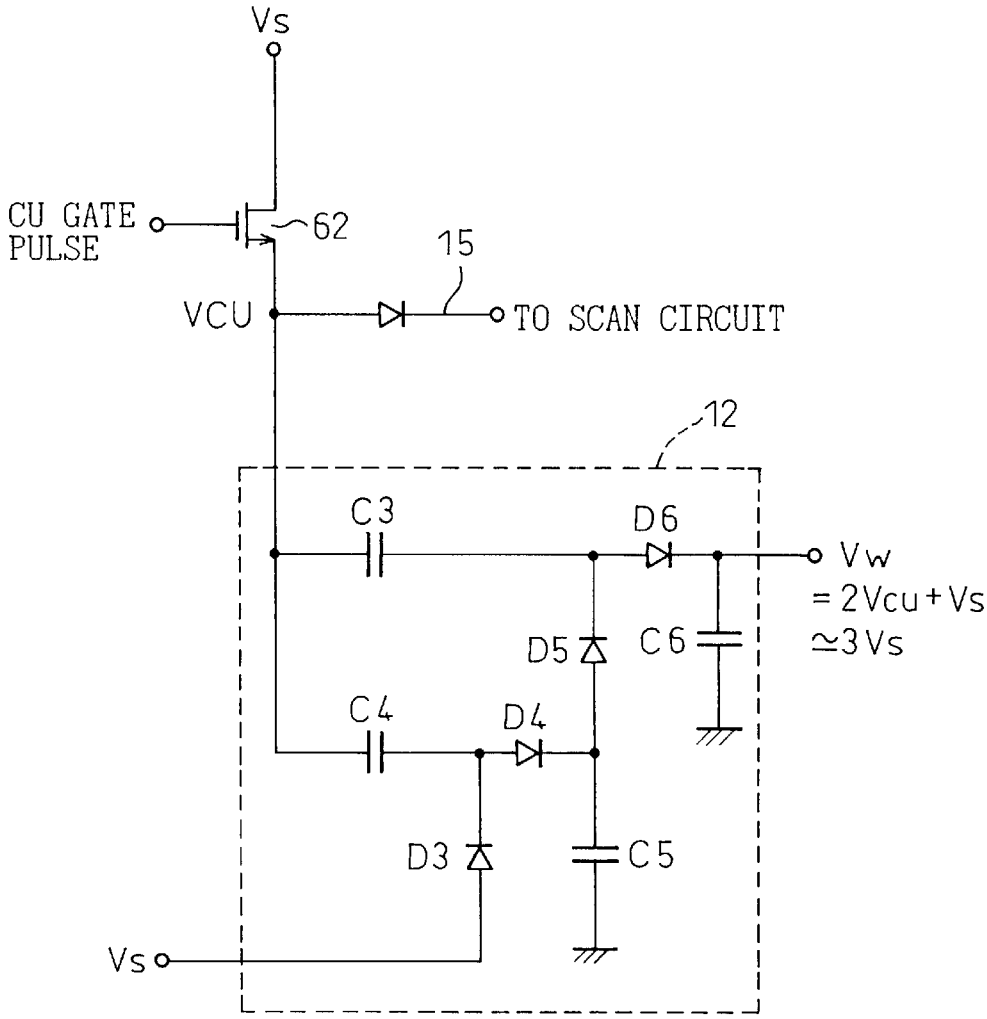
FIG. 7 is a diagram that shows the circuit structure (example 2) of the Vw voltage generator circuit in the first embodiment.

FIG. 7 is a diagram that shows an example of the second structure of the Vw voltage generator circuit. In this example, the part which is composed of capacitors C4 and C5 and diodes D3 and D4 is the charge-pump circuit same as that shown in FIG. 6, and a voltage of 2 Vs is supplied to the anode of diode D5. The part which is composed of capacitors C3 and C6, the diode D5, and diode D6 is also the charge-pump circuit, and a voltage of 2 Vs is supplied to the anode of the diode D5, therefore, the voltage to be put out is nearly 3 Vs, which is 2 Vs plus Vs. In this way, an even higher voltage can be obtained by increasing the number of stages of the charge-pump circuit.

As described above, a power supply circuit of 2 Vs can be realized by utilizing the power supply voltage Vs, which is the same as that of the sustain pulse, and the charge-pump circuit that uses the sustain pulse, and moreover, a power supply circuit of integer multiples of Vs can be realized by increasing the number of stages of the charge-pump circuit. A required voltage, however, is not always that of integer multiples of Vs, and it may happen that a voltage of 1.5 Vs is required. The example, which will be described below, is an example of a power supply circuit that puts out an intermediate voltage.

Figure 8:
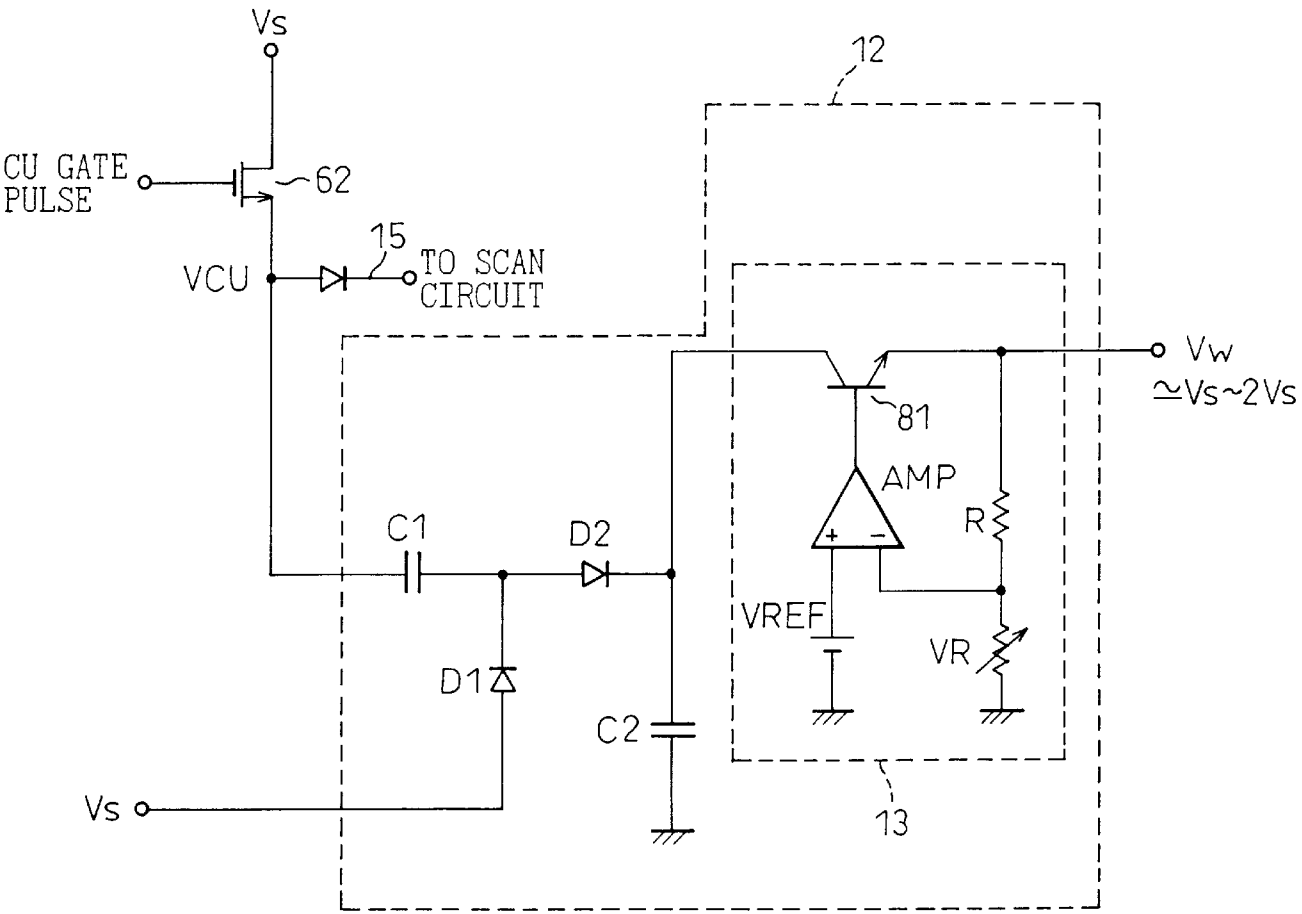
FIG. 8 is a diagram that shows the circuit structure (example 3) of the Vw voltage generator circuit in the first embodiment.

FIG. 8 is a diagram that shows an example of the third structure of the Vw voltage generator circuit. In this example, a voltage stabilizer circuit 13 is added to the first example in FIG. 6 and a voltage Vw can be obtained arbitrarily between Vs and 2 Vs. The voltage stabilizer circuit 13 comprises a bipolar transistor 81 the collector of which is connected to the capacitor C2, an operational amplifier AMP the output of which is connected to base of the transistor 81, a reference voltage source VREF, a resistor R, and a variable resistor VR. From this circuit, the output voltage Vw expressed as below can be obtained.

$$Vw=VREF(VR+R)/VR.$$

In the expression, VREF is the value of the reference voltage, VR and R are values of the variable resistor and the resistor, respectively.

Therefore, an arbitrary voltage equal to 2 Vs or less can be obtained by adjusting the variable resistor.

Figure 9:
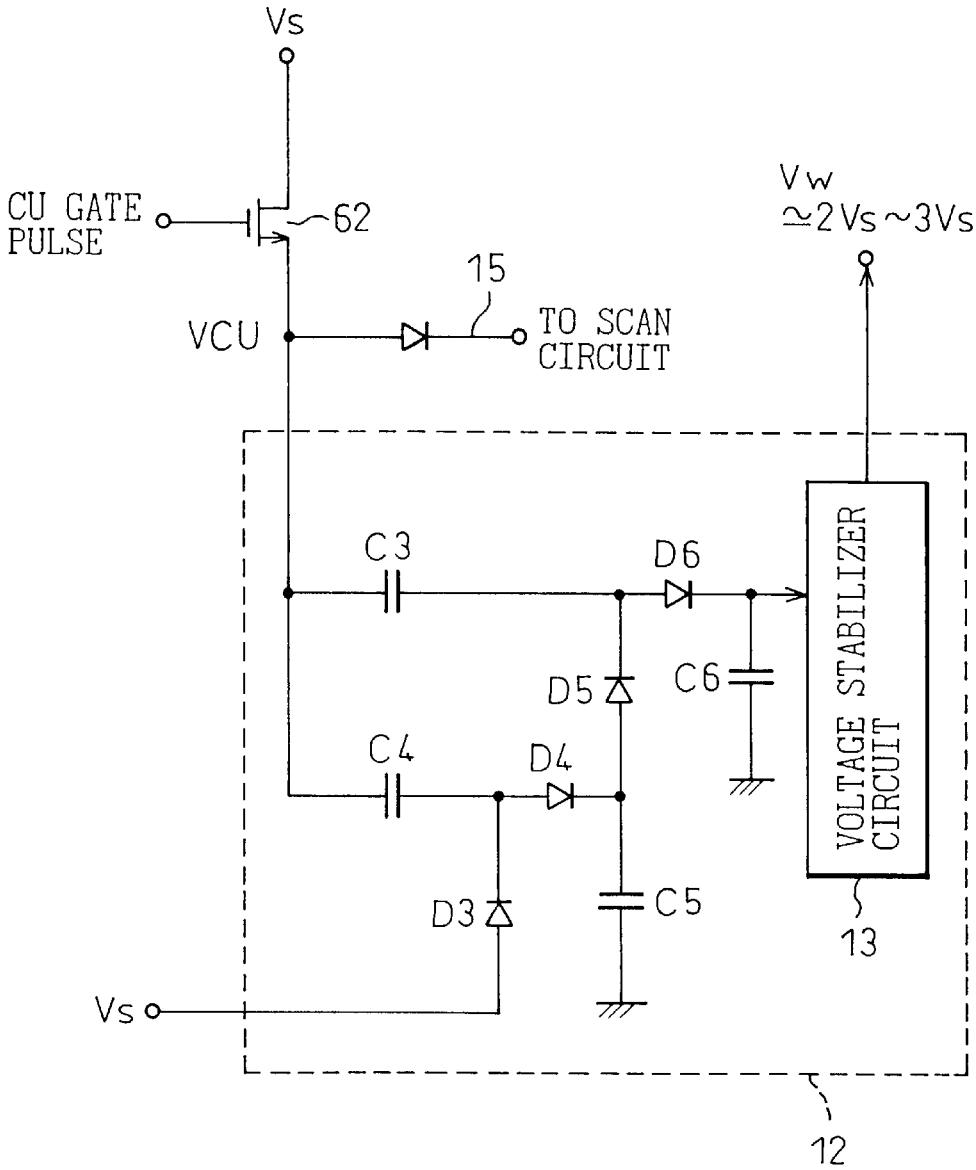
FIG. 9 is a diagram that shows the circuit structure (example 4) of the Vw voltage generator circuit in the first embodiment.

FIG. 9 is a diagram that shows an example of the fourth structure of the Vw voltage generator circuit. In this example, the voltage stabilizer circuit 13 is added to the second example shown in FIG. 7 and an arbitrary voltage between about 2 Vs and 3 Vs can be obtained as a voltage 2 Vw. A further description is omitted here.

Figure 10:
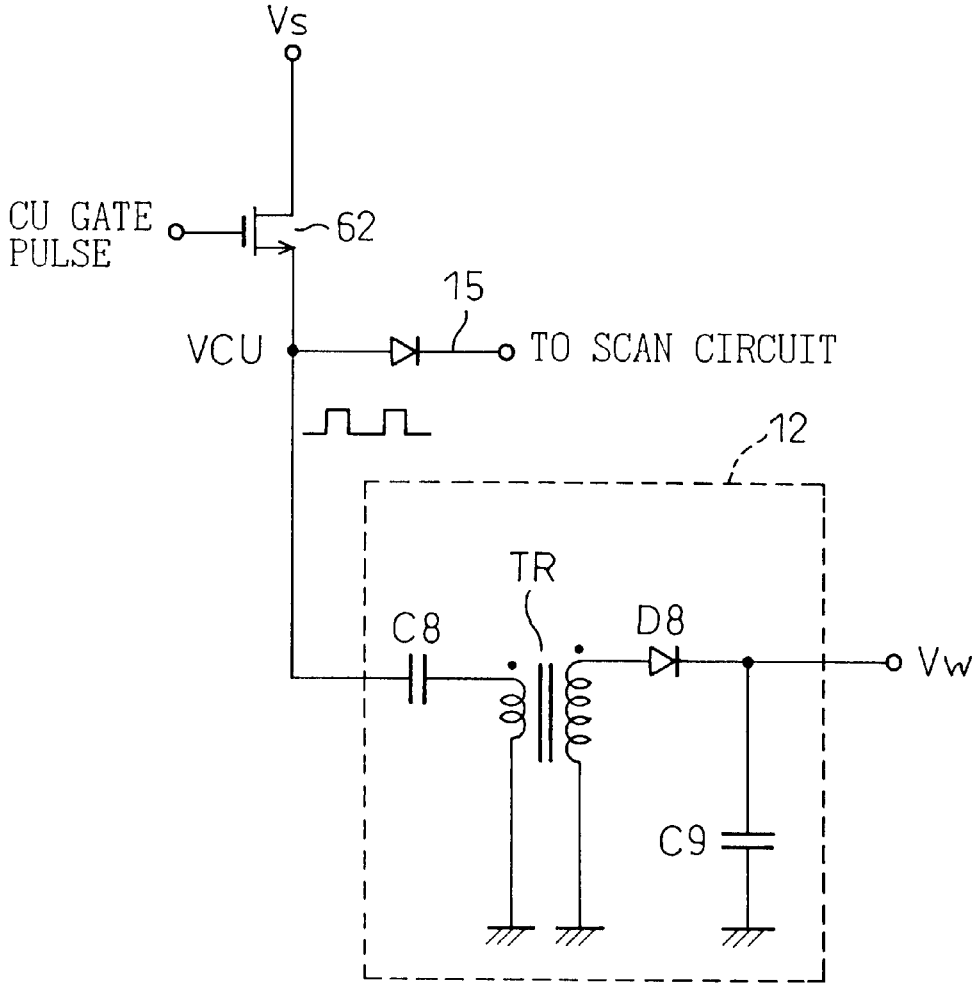
FIG. 10 is a diagram that shows the circuit structure (example 5) of the Vw voltage generator circuit in the first embodiment.

FIG. 10 is a diagram that shows an example of the fifth structure of the Vw voltage generator circuit. In this example, a circuit, which is a combination of a voltage ste-up circuit that has a transformer TR and a rectifier circuit, is employed instead of the charge-pump circuit. A voltage is induced on the secondary by applying the voltage pulse VCU, which corresponds to the sustain pulse, to the primary of the transformer TR via a capacitor C8. If the number of turns of the secondary winding is increased to a number greater than that of the primary winding, an alternating current with a voltage greater than the voltage pulse VCU can be obtained, therefore, a voltage Vw greater than Vs can be output by rectifying the alternating current by the diode and a capacitor C9.

Figure 11:
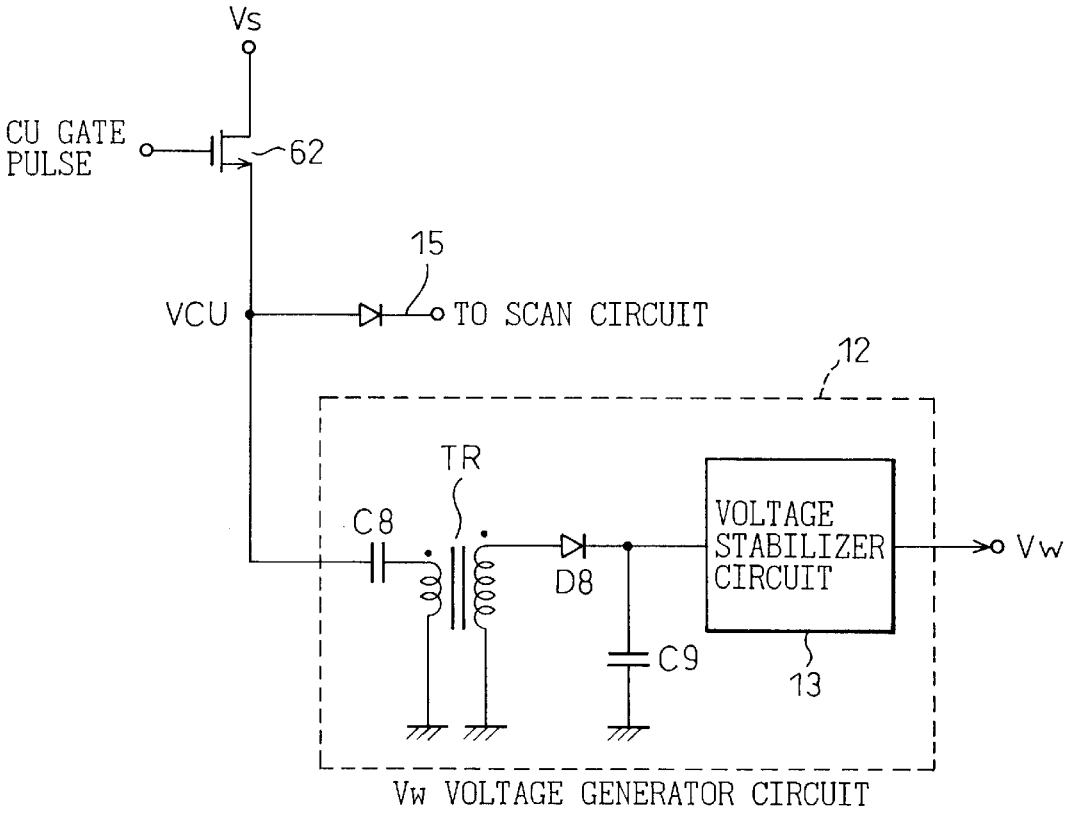
FIG. 11 is a diagram that shows the circuit structure (example 6) of the Vw voltage generator circuit in the first embodiment.

FIG. 11 is a diagram that shows an example of the sixth structure of the Vw voltage generator circuit and, in this example, the voltage stabilizer circuit 13 is added to the example of the fifth structure shown in FIG. 10, therefore, a further description is omitted here.

The present applicants have disclosed the art to reduce the voltage generated in the PDP apparatus in Japanese Patent Application No.2000-188663. The present invention can be also applied to a PDP apparatus that employs this art and such an example is shown as the second embodiment.

Figure 12:
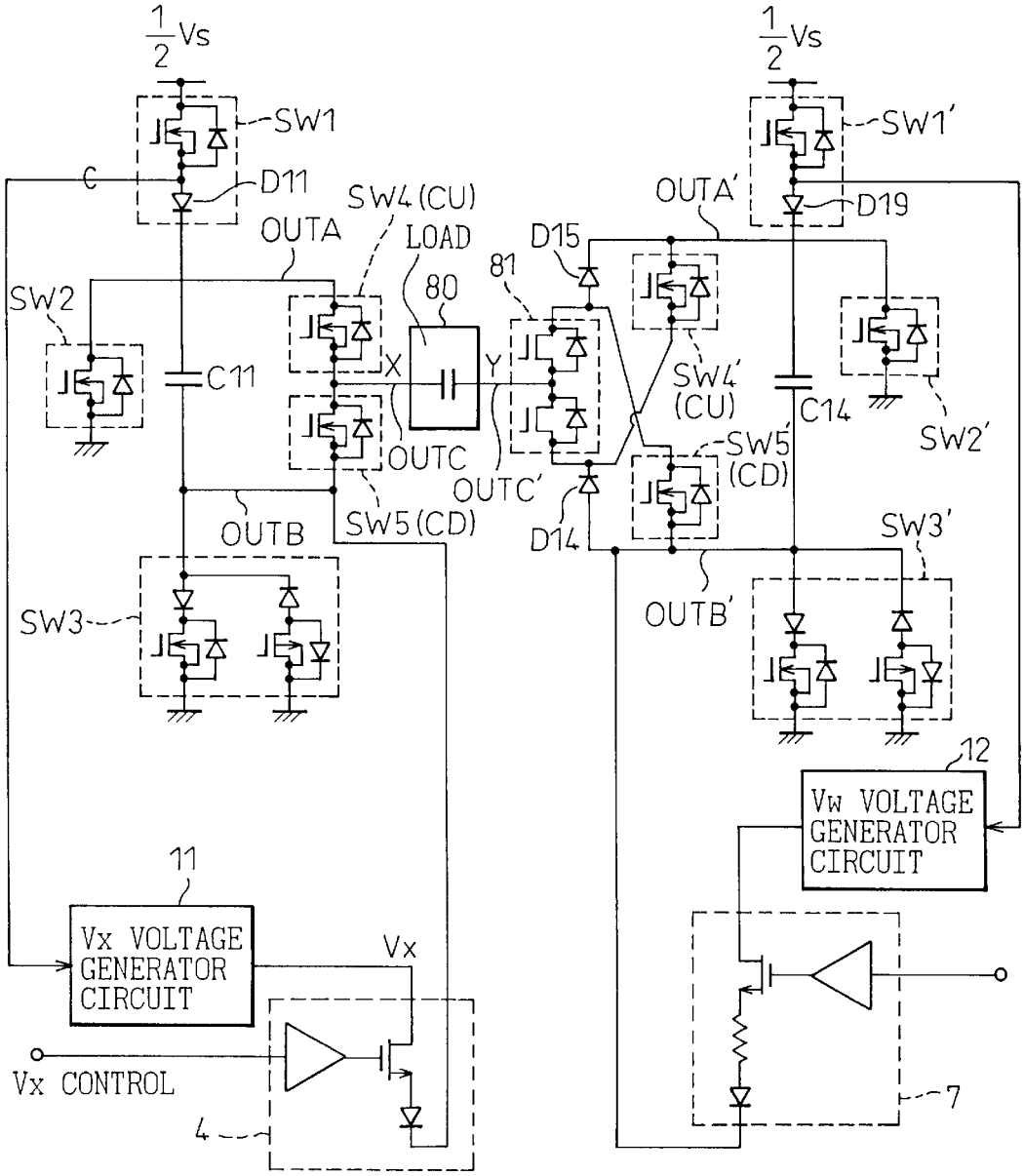
FIG. 12 is a diagram that shows the circuit structure of the drive section of the PDP apparatus in the second embodiment of the present invention.

FIG. 12 is a diagram that shows the circuit structure in the second embodiment, in which the present invention is applied to the PDP apparatus that employs the voltage reduction drive circuit disclosed in Japanese Patent Application No.2000-188663, and the drive circuits on the X electrode side and the Y electrode side are shown. Since it has been disclosed in Japanese Patent Application No.2000-173056, a detailed description of the entire drive circuit is omitted and only the part relating to the present invention is described here.

In this circuit, a pulse of voltage Vs/2 output from the transistor that constitutes switch SW1 on the X side is used as an input pulse to the Vx voltage generator circuit 11. Similarly, a pulse of voltage Vs/2 output from the transistor that constitutes switch SW1' on the Y side is used as an input pulse to the Vw voltage generator circuit 12. The voltage generator circuit 11 and the Vw voltage generator circuit 12 in this case can be realized by the structures shown as examples in FIG. 6 through FIG. 11.

Figure 13:
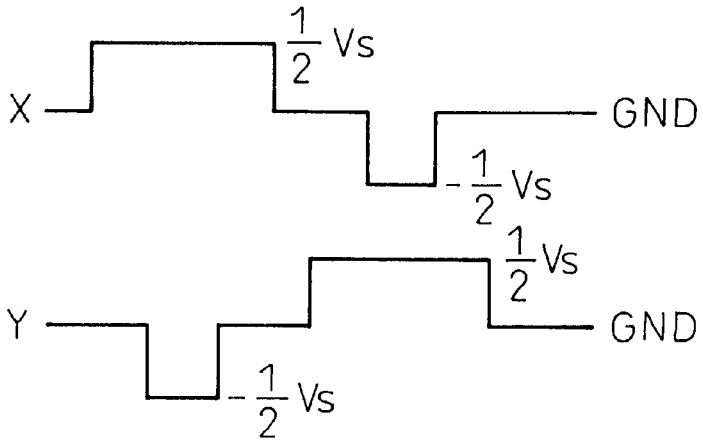
FIG. 13 is a diagram that shows the drive waveforms in the sustaining operation in the second embodiment.

FIG. 13 shows the waveforms of the sustain pulse to be applied to the X electrode and the Y electrode in the sustain period in the second embodiment, and the above-mentioned Vx voltage generator circuit 11 and the Vw voltage generator circuit 12 generate Vx and Vw from this sustain pulse.

Figure 14:
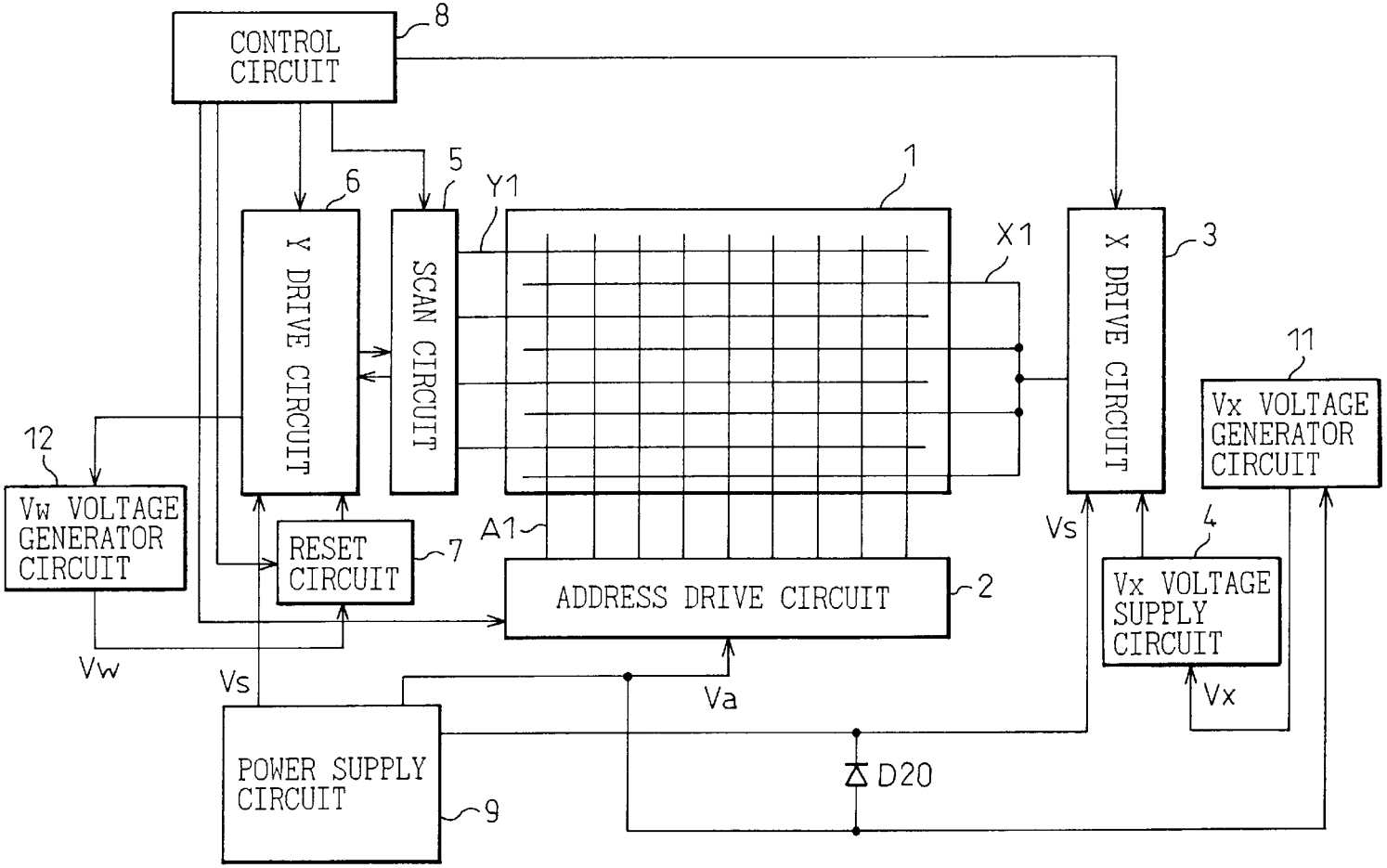
FIG. 14 is a rough block structure diagram of the PDP apparatus in the third embodiment of the present invention.

FIG. 14 is a block diagram that shows the rough structure of the PDP apparatus in the third embodiment of the present invention. The PDP apparatus in the third embodiment is an example case in which the voltage Vx to be applied to the X electrode in the address period is less than the voltage Va of the address pulse. As is obvious, by comparison with FIG. 3, the structure in the third embodiment differs in that the power supply voltage Va, which is to be supplied from the power supply circuit 9 to the address drive circuit 2, is applied to the Vx voltage generator circuit 11, instead of the sustain pulse generated in the X drive circuit 3, and that a diode D20 is provided between the supply path of the power supply voltage Va and the supply path of the power supply voltage Vs to the X drive circuit 3.

Figure 15:
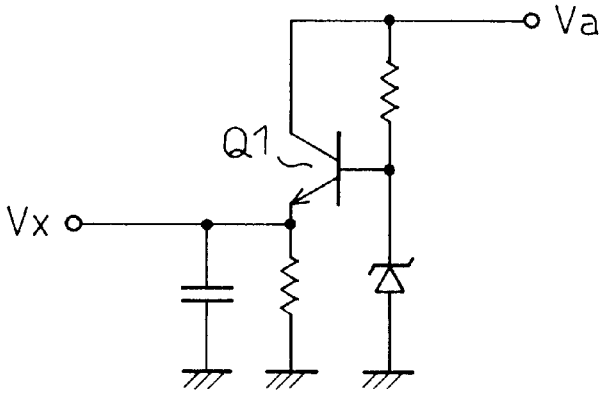
FIG. 15 is a circuit diagram that shows the Vx voltage generator circuit in the third embodiment.

FIG. 15 is an example of the Vx voltage generator circuit 11 and Vs is generated by stepping down Va, because the voltage Vx is less than the voltage Va.

Figure 16A:
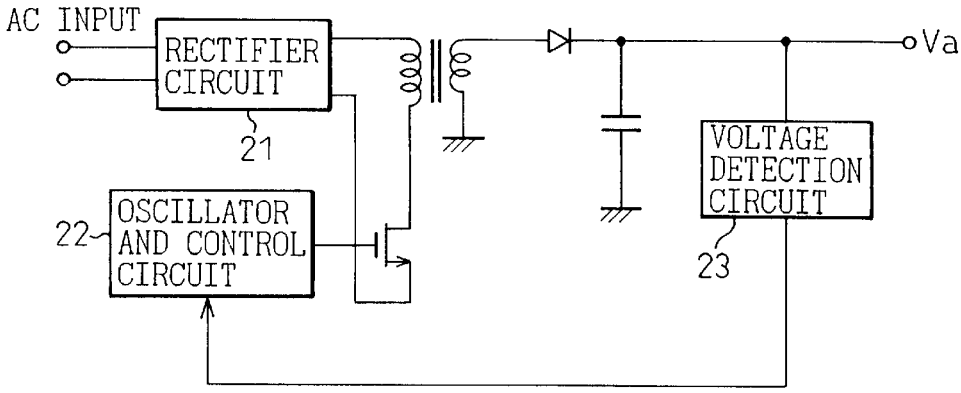
FIG. 16A and FIG. 16B are circuit diagrams that show the Va voltage generator circuits in the third embodiment.
Figure 16B:
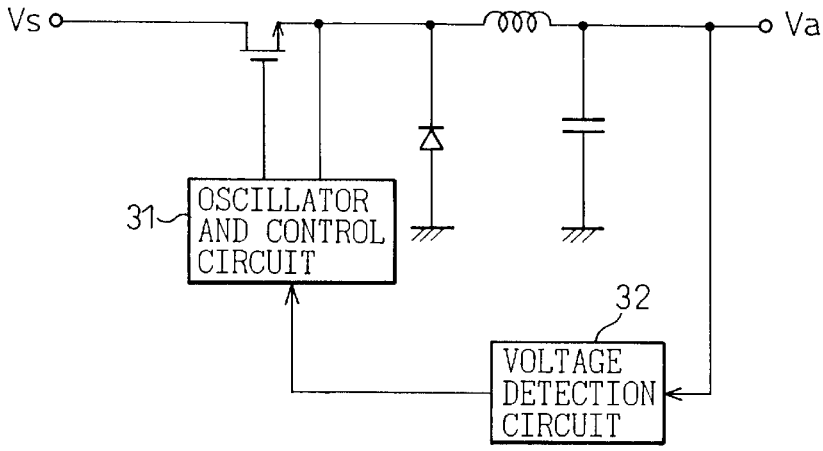

FIG. 16A and FIG. 16B are examples of the structure of the Va voltage generator circuit in the power supply circuit 9. In the circuit shown in FIG. 16A, an AC input from the outside is rectified in a rectifier circuit 21 to generate a DC power supply, which is used as the power supply of the transformer. The AC output is induced on the secondary by controlling the transistor on and off, which is provided in the current supply path to the transformer, in an oscillator and control circuit 22, to cut off the current supply to the transformer. The AC output is then rectified in the rectifier circuit composed of diodes and capacitors to obtain the voltage Va. The output voltage Va is detected in a voltage detection circuit 23 and a fixed voltage can be obtained constantly by controlling the oscillator and control circuit 22 to adjust the duty ratio of the current supply to the transformer based on the detection result.

In the circuit shown in FIG. 16B, the transistor is ON-OFF controlled by an oscillator and control circuit 31 to intermittently supply the power supply voltage Vs and the power supply voltage Vs is rectified to generate a desired voltage Va. The output voltage Va is detected in a voltage detection circuit 32 and a fixed voltage can be obtained constantly by controlling the oscillator and control circuit 31 to adjust the duty ratio of the current supply to the transformer based on the detection result.

In the circuit shown in FIG. 14, the voltage Vx is less than the voltage Va and the power supply voltage Va is supplied to the Vx voltage generator circuit. In this circuit, normally, Vs>Va, but there is a possibility of Vs<Va because Va rises prior to Vs due to the relation of the power turning on sequence in the transition period such as power on and power off. In this case, there is a possibility of current passing from the power supply circuit 9 through the Vx voltage generator circuit 11 and the voltage Vx supply circuit 4 to damage the transistor Q1 in the Vx voltage generator circuit 11. Therefore, in the structure in the third embodiment, the protection diode D20 is provided, and when Vs<Va, the protection diode 20 turns on to prevent current from passing into the transistor Q1.

As described above, according to the plasma display apparatus of the present invention, the secondary power supply such as the power supply voltages Vw and Vx is generated using the pulse generated in the X drive circuit or the Y drive circuit, therefore, the oscillator circuit and the switching device, which are conventionally necessary to form these secondary power supplies, can be omitted, resulting in reduction in circuit size and cost.

Moreover, in the plasma display apparatus of the present invention, the first power supply voltage Vs is used as the power supply voltage to be supplied to the X drive circuit and the Y drive circuit, and at the same time the power supply voltage Va, which is to be supplied to the address drive circuit, is used as the second power supply voltage. When the first power supply voltage Vs is less than the second power supply voltage Va, a circuit is further provided, which passes current from the supply line of the second power supply voltage Va to that of the first power supply voltage Vs, therefore, in such a case, it is possible to avoid such as malfunctions of the circuit by preventing abnormal current that passes into the X drive circuit or the Y drive circuit via the circuits that constitute the above-mentioned secondary power supply. In this way, the reliability of the circuit is improved.

What is claimed is:

1. A plasma display apparatus comprising a display panel, having first electrodes and second electrodes adjacently arranged and third electrodes that extend in a direction intersecting the first electrodes and the second electrodes, opposed to each other so as to sandwich a discharge space therebetween, an X drive circuit that drives the first electrodes, a Y drive circuit that drives the second electrodes, an address drive circuit that drives the third electrodes, and a secondary power supply that uses a pulse relating to the drive signal generated in the X drive circuit or the Y drive circuit.

2. A plasma display apparatus as set forth in claim 1, wherein the pulses used by the secondary power supply includes at least a pulse relating to a sustain pulse generated in a sustain period.

3. A plasma display apparatus as set forth in claim 1, wherein the secondary power supply comprises a charge-pump circuit driven by the pulse and a rectifier circuit that rectifies the output of the charge-pump circuit and generates a direct current voltage.

4. A plasma display apparatus as set forth in claim 3, wherein the charge-pump circuit comprises a charge-pump circuit equipped with plural stages, in which the output of a preceding stage is entered as a base voltage of a subsequent stage.

5. A plasma display apparatus as set forth in claim 1, wherein the secondary power supply comprises a transformer having a primary and a secondary, and to the primary of which transformer the pulse is supplied, and a rectifier circuit that rectifies the output of the secondary of the transformer and generates a direct current voltage.

6. A plasma display apparatus as set forth in claim 3, wherein the secondary power supply comprises a voltage stabilizer circuit that converts the output of the rectifier circuit to a fixed voltage.

7. A plasma display apparatus as set forth in claim 5, wherein the secondary power supply comprises a voltage stabilizer circuit that converts the output of the rectifier circuit to a fixed voltage.

8. A plasma display apparatus as set forth in claim 1, wherein the secondary power supply generates a voltage to be applied to the first electrode in the address period.

9. A plasma display apparatus as set forth in claim 1, wherein the secondary power supply generates a voltage to be applied to the second electrode in the reset period.

10. A plasma display apparatus comprising a display panel, having first electrodes and second electrodes adjacently arranged and third electrodes that extend in the direction intersecting the first electrodes and the second electrodes, opposed to each other so as to sandwich a discharge space therebetween, an X drive circuit that drives the first electrodes, a Y drive circuit that drives the second electrodes, and an address drive circuit that drives the third electrodes, wherein a first power supply voltage is supplied to the X drive circuit and the Y drive circuit and a second power supply voltage is supplied to the address drive circuit, said apparatus further comprising a voltage generator circuit that generates a third power supply voltage based on the second power supply voltage, and supplies the third power supply voltage to the X drive circuit or the Y drive circuit.

11. A plasma display apparatus as set forth in claim 10, further comprising a circuit that passes a current from a first path, through which the second power supply voltage is supplied to the address drive circuit, to a second path, through which the first power supply voltage is supplied to the X drive circuit or the Y drive circuit, when the first power supply voltage is less than the second power supply voltage.

12. A plasma display apparatus as set forth in claim 11 wherein, the circuit that passes the current from the first path, through which the second power supply voltage is supplied to the address drive circuit, to the second path, through which the first power supply voltage is supplied to the X drive circuit or the Y drive circuit, comprises a protection switch.

13. A plasma display apparatus as recited in claim 10, wherein the third power supply voltage is supplied to the first electrode during an address period.

14. A plasma display apparatus, comprising:

a display panel having first and second adjacent electrodes spaced from, and crossing, opposing third electrodes and defining a discharge space therebetween;

X, Y, and address drive circuits that drive the first, second and third electrodes, respectively; and a secondary power supply that uses a pulse relating to the drive signal generated in the X drive circuit or the Y drive circuit.

15. A plasma display apparatus as set forth in claim 14, wherein the pulse used by the secondary power supply includes at least a pulse relating to a sustain pule generated in a sustain period.

16. A plasma display apparatus as set forth in claim 14, wherein the secondary power supply comprises a charge-pump circuit driven by the pulse and a rectifier circuit that rectifies the output of the charge-pump circuit and generates a direct current voltage.

17. A plasma display apparatus as set forth in claim 16, wherein the charge-pump circuit comprises a charge-pump circuit equipped with plural stages, in which the output of a preceding stage is entered as a base voltage of a subsequent stage.

18. A plasma display apparatus as set forth in claim 14, wherein the secondary power supply comprises a transformer having a primary and as secondary, and to the primary of which transformer the pulse is supplied, and a rectifier circuit that rectifies the output of the secondary of the transformer and generates a direct current voltage.

19. A plasma display apparatus as set forth in claim 16, wherein the secondary power supply comprises a voltage stabilizer circuit that converts the output of the rectifier circuit to a fixed voltage.

20. A plasma display apparatus as set forth in claim 18, wherein the secondary power supply comprises a voltage stabilizer circuit that converts the output of the rectifier circuit to a fixed voltage.

21. A plasma display apparatus as set forth in claim 14, wherein the secondary power supply generates a voltage to be applied to the first electrode in the address period.

22. A plasma display apparatus as set forth in claim 14, wherein the secondary power supply generates a voltage to be applied to the second electrode in the reset period.

23. A plasma display apparatus, comprising:

a display panel having first and second adjacent electrodes spaced from, and crossing, opposing third electrodes and defining a discharge space therebetween;

S, Y, and address drive circuits that drive the first, second and third electrodes, respectively;

a secondary power supply that uses a pulse relating to the drive signal generated in the X drive circuit or the Y drive circuit;

a power supply supplying a first power supply voltage to the X drive circuit and the Y drive circuit and a second power supply voltage to the address drive circuit; and a voltage generator circuit generating a third power supply voltage, based on the second power supply voltage, and supplying the third power supply voltage to the X drive circuit or the Y drive circuit.

24. A plasma display apparatus as set forth in claim 23, further comprising a circuit that passes a current from a first path, through which the second power supply voltage is supplied to the address drive circuit, to a second path, through which the first power supply voltage is supplied to the X drive circuit or the Y drive circuit, when the first power supply voltage is less than the second power supply voltage.

25. A plasma display apparatus as set forth in claim 24, wherein the circuit that passes the current from the first path, through which the second power supply voltage is supplied to the address drive circuit, to the second path, through which the first power supply voltage is supplied to the X drive circuit or the Y drive circuit, comprises a protection switch.

26. A plasma display apparatus as set forth in claim 23, wherein the third power supply voltage is supplied to the first electrode during an address period.

* * * * *

UNITED STATES PATENT AND TRADEMARK OFFICE

CERTIFICATE OF CORRECTION

PATENT NO. : 6,617,800 B2
DATED : September 9, 2003
INVENTOR(S) : Makoto Onozawa et al.

It is certified that error appears in the above-identified patent and that said Letters Patent is hereby corrected as shown below:

Column 12,
Line 22, change "S,Y" to -- X,Y --.

Signed and Sealed this

Tenth Day of February, 2004

JON W. DUDAS
*Acting Director of the United States Patent and Trademark Office*